United States Patent [19]

Moor

[11] Patent Number: 4,848,798

[45] Date of Patent: Jul. 18, 1989

[54] PERFORATED INTERIOR BINDER POCKET

[75] Inventor: Marc L. Moor, Dayton, Ohio

[73] Assignee: The Mead Corporation, Dayton, Ohio

[21] Appl. No.: 248,222

[22] Filed: Sep. 23, 1988

[51] Int. Cl.[4] ..... B42D 3/00; B42D 3/02; B42F 13/00

[52] U.S. Cl. ..... 281/31; 281/29

[58] Field of Search ..... 402/70, 73; 281/29, 281/31

[56] References Cited

U.S. PATENT DOCUMENTS

| | | | |
|---|---|---|---|
| 1,524,647 | 2/1925 | Albrecht . | |
| 2,523,724 | 9/1950 | Satz | 281/31 |
| 3,227,471 | 1/1966 | Coniker | 281/31 |
| 3,870,223 | 3/1975 | Wyant | 229/72 |
| 4,420,112 | 12/1983 | Cline | 281/31 X |
| 4,743,049 | 5/1988 | Wiberg | 281/31 |

FOREIGN PATENT DOCUMENTS

| | | | |
|---|---|---|---|
| 1279118 | 11/1961 | France | 281/31 |

*Primary Examiner*—Paul A. Bell

*Attorney, Agent, or Firm*—Biebel, French & Nauman

[57] ABSTRACT

A perforated interior binder pocket is provided for use in conjunction with binders having hingedly connected covers. The perforated interior binder pocket is located on at least one cover of the binder. The pocket has first and second walls which are molded together on three sides. The first wall includes a plurality of apertures arranged in a geometric pattern, with the pattern being separated from the plastic cover which forms the inner surface of the binder cover by a border portion. A vertical opening is provided adjacent the border with this opening extending from the top to the bottom of the binder cover.

20 Claims, 3 Drawing Sheets

PERFORATED INTERIOR BINDER POCKET

BACKGROUND OF THE INVENTION

The present invention relates generally to portfolios, binders and the like, and more particularly, to such a device including a binder pocket incorporated thereinto.

The difficulty of carrying or storing pieces of paper, or especially those of a diffeent dimension than designed to be held by the primary paper retaining means of a binder, in a portfolio, ring binder or the like has been recognized for many years. The terms "portfolio" and "binder" may be used interchangeably herein with the understanding that "binder" refers generically to hinged folders whether or not binder rings are provided. One solution to the problem is disclosed in U.S. Pat. No. 3,870,223, wherein the interior of the binder cover has a plurality of horizontal slits therein for insertion of sheets of paper into the interior compartment of the folder between its outer and inner wall.

Another approach is disclosed in U.S. Pat. No. 2,523,724, wherein a pouch having a horizonal slot for an opening is provided on the inside of a binder cover.

A more current and common approach to storage problems is disclosed in U.S. Pat. No. 4,420,112, wherein construction of a portfolio is disclosed as being comprised of unperforated outer, middle and inner sheets, with an arcuate portion of the inner sheet being removed to facilitate in the insertion of sheets of paper into an enclosed pocket between the inner and middle portions of the cover.

Unfortunately, in each of the known storage arrangements, it is difficult if not impossible to establish visual contact with the contents contained within the pocket. Even if the pocket is fabricated from a transparent material, such materials tend to become dirty or scratched over time to a degree sufficient to diminish visibility. This is especially true if the sheet form item is of an extremely small size. Additionally, the sheets of paper are subject to unwanted creases from closing of the binder cover when the papers are in a folded-over position. Attempting to add additional binder clips at the top of the cover may interfere with the ring binder or a clip on the rear panel of the portfolio or leave a mark on the paper such that the problem continues.

It is thus apparent that the need exists for an improved interior pocket for a binder or the like which provides the establishment of visual contact with the contents contained beneath the pocket.

SUMMARY OF THE INVENTION

The problems associated with the prior storage arrangements are overcome in accordance with the present invention by forming a perforated interior pocket for a binder or the like as an integral portion of the covering of at least one cover of the binder.

A plastic cover overlaying the inner surface of a relatively stiff panel defining at least one of the covers of a binder is itself overlaid with a second plastic cover to define a binder pocket. The first and second plastic covers are secured along three sides thereof with the fourth edge of the plastic cover defining the vertical opening to the binder pocket.

Preferably the second plastic cover does not completely overlay the first plastic cover, and in fact preferably extends approximately 60–70% of the width of the first plastic cover, such that articles inserted into the binder pocket, will have portion thereof projecting from the opening to the interior pocket.

Additionally, the second plastic cover overlays an intermediary panel of the binder and a portion of a second cover of the binder. The second plastic cover is secured to the first plastic cover on opposite sides of the intermediary panel, with further retention of the second plastic cover to the binder being provided by the mechanical fastening of a paper retaining means to a relatively stiff panel of the intermediary panel with the fastening means for the paper retaining means passing through both the first and second plastic covers.

The second plastic cover has a plurality of apertures therein which form a geometric pattern. The presence of these apertures in the second plastic cover permit the first plastic cover to be visible through the apertures. Furthermore, the presence of any item in the binder pocket is also discernable.

It is a primary object of the present invention to provide a binder structure incorporating a perforated interior binder pocket which is conveniently and inexpensively formed during the assembly of the binder, which perforated interior binder pocket provides secure yet visible storage of paper, while additionally creating an interesting visible effect.

Other objects and advantages of the invention will be apparent from the following description, the accompanying drawings and the appended claims.

DETAILED DESCRIPTION OF THE INVENTION

Figure 1:
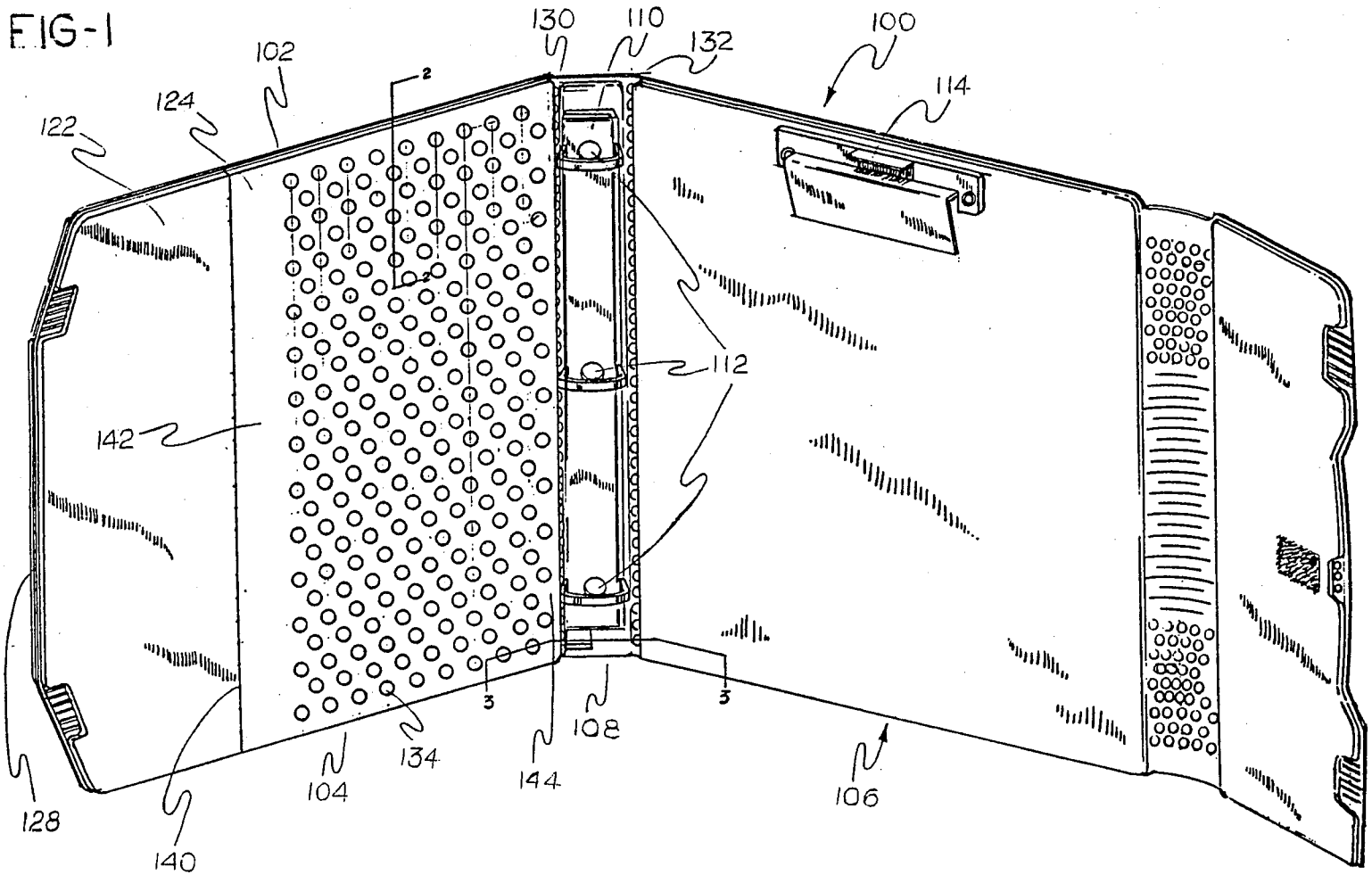
FIG. 1 is a perspective view of a binder including a perforated interior binder pocket in accordance with the present invention.

FIG. 1 is a perspective view of a binder 100 including a perforated interior binder pocket 102 in accordance with the present invention. Binder 100 comprises a front cover 104 and a rear cover 106 which, in the illustrative embodiment, are hingedly connected to a center binder back strip 108 upon which is mounted a conventional loose-leaf binding device 110 by means of rivets 112 or other appropriate connectors. A clip 114 for holding a pad of notebook paper or the like may be secured to rear cover 106.

In the illustrated embodiment, the front and rear covers 104,106 comprise relatively stiff panels 118,119 while the center binder back strip 108 comprises a much narrower relatively stiff panel 120. All of the panels 118, 119, 120 can be formed from chip board, cardboard, or other appropriate material.

Figure 2:
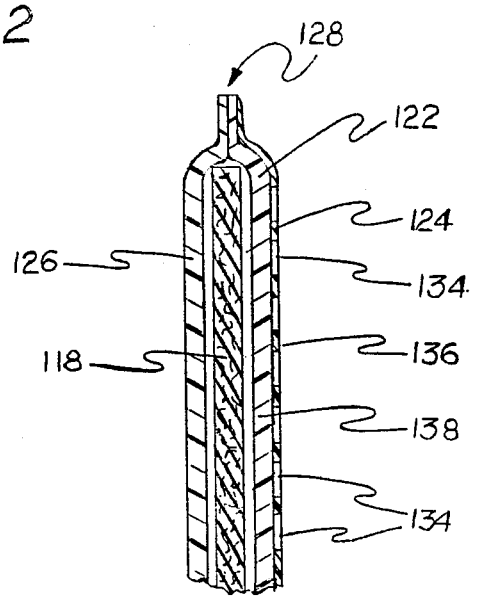
FIG. 2 is an exploded view showing the components which are used to form the binder and binder pocket as would be seen along the view line 2 in FIG. 1.
Figure 3:
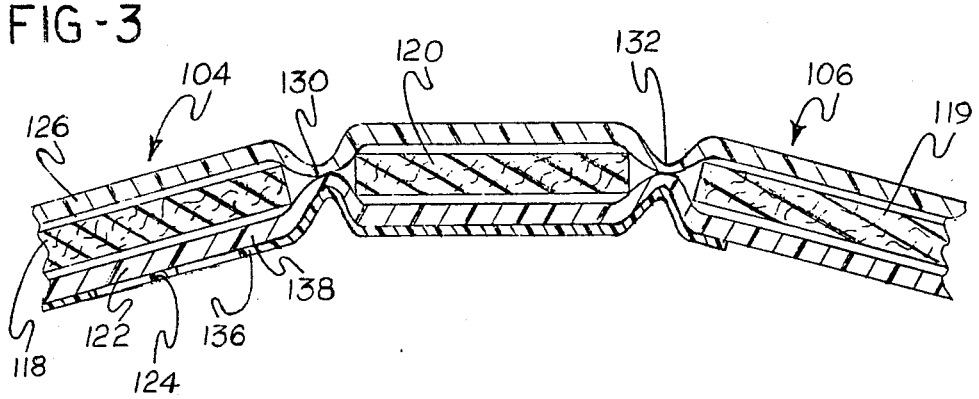
FIG. 3 is an exploded view showing the components which are used to form the binder and binder pocket as would be seen along the view line 3 in FIG. 1.

As best shown in FIGS. 2 and 3, a first plastic cover 122 overlays the inner surface of the panels 118, 119 and 120. A second plastic cover 124 overlays a portion of said first plastic cover 122 with the top and bottom edges of first plastic cover 122 and second plastic cover 124 being welded together around the top and bottom edges of the panels 118, 119 and 120 in a conventional manner. The inner plastic cover may be of a first color while the second plastic cover may be of a second color, or both covers may be fabricated from material of the same color. The outer surface of the panels 118, 119 and 120 is overlaid by a third plastic cover 126 with this outer plastic cover being welded to the inner plastic cover 122 around the peripheral edges 128 of the binder. The plastic covers may be opaque, translucent or even transparent.

Second plastic cover 124 extends approximately 60–70% of the width of front cover 104. Additionally, second plastic cover 124 preferable extends completely across intermediary panel 108 beneath the paper retaining means 110 and extends over a portion of rear cover 106. In addition to the three plastic covers being welded along a portion of the top and bottom edges of the binder 100, they are also welded together at hinges 130,132.

Second plastic cover 124 has a plurality of apertures 134 formed therein. In the preferred embodiment these apertures all have the same diameter of approximately ¼ inch, but they could be of various sizes and configurations. Preferably these apertures are arranged in a geometric pattern, such as staggered rows. Due to the presence of the apertures 134, the first cover is visible through apertures 134, further highlighting the geometric pattern. This highlighting is further accentuated if there is a pronounced difference between the colors of the first and second plastic covers 122,124.

The second plastic cover 124 being secured to the top and bottom edges of front cover 104 as well as along hinge 130 forms a first wall 136 of interior binder pocket 102. The overlaid portion of first plastic cover 122 thus forms a second wall 138 of binder pocket 102. As formed, binder pocket 102 has a vertical opening 140 thereinto.

Figure 4:
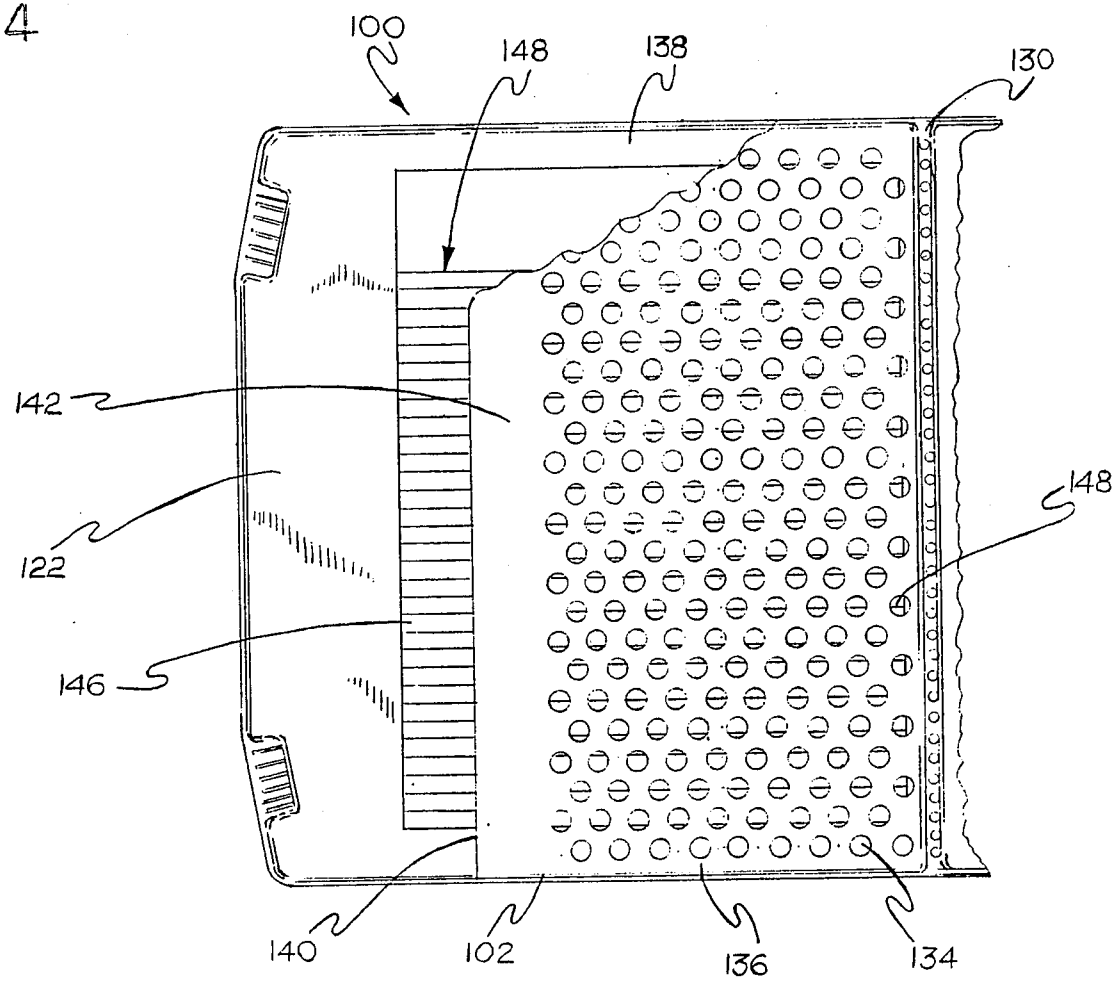
FIG. 4 is a partially broken away plan view of a binder cover with perforated binder pocket showing a sheet of paper being stored in the binder pocket.

As can be observed best in FIGS. 1 and 4, a portion of second plastic cover 124 adjacent vertical opening 140 contains no apertures 134, thereby forming a first solid border 142 preferably between ½ and 2½ inches. If border 142 is of a color different than first plastic cover 122 and since border 142 is devoid of apertures 134, the visual interaction of first and second plastic coves 122,124 presents the viewer with three distinct visual images, thereby creating a further interesting visual effect. This effect can be accentuated through the use of complementary or contrasting hues of plastic. A second border 144 is formed between hinge 130 and the area of the second plastic cover 124 which contains the aperture 134.

As best shown in FIG. 4, the perforated interior binder pocket is designed to have sheets of paper 144 inserted therein. Preferably the width of the second plastic cover is less than 8½ inches, and more than 6 inches, so as to permit a portion of sheet 144 to be visible to the user of the binder 100 outside pocket 102. In actual use, the sheet of paper 144 is inserted between first and second walls 136 and 138 such that some of the printing 146 or other ornamentation on the sheet 144 may be visible through apertures 134. This further creates an interesting visual effect when the binder is in use, in addition to the fact that the color of the paper itself is visibly contrasted with the color of the first plastic cover. Upon removal of the sheet 144 from binder pocket 102, it is very easy to discern whether other items are contained within the binder pocket, even if their dimensions are such that an edge thereof does not extend through vertical opening 140.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A binder comprising front and rear hingedly connected covers wherein at least one of said covers comprises:

a relatively stiff panel, a first plastic cover overlaying the inner surface of said panel, a second plastic cover overlaying a portion of said first plastic cover, said second plastic cover secured to said first plastic cover along three sides thereof for forming a first wall of a binder pocket, said overlaid portion of said first plastic cover forming a second wall of said binder pocket, said first wall having a plurality of apertures therein arranged in geometric pattern comprises of staggered rows of said apertures such that portions of said second wall are visible therethrough.

2. A binder as claimed in claim wherein said binder pocket has a vertical opening.

3. A binder as claimed in claim 2 wherein said opening extends approximately from the top to the bottom of said panel.

4. A binder as claimed in claim 2 wherein said second plastic cover overlays more than one-half of said first plastic cover.

5. A binder as claimed in claim 1 wherein said first wall includes a first solid border section between said vertical opening and said geometric pattern.

6. A binder as claimed in claim 5 wherein said first wall includes a second solid border section adjacent said geometric pattern.

7. A binder as claimed in claim 1 wherein said first plastic cover being of a first color and said second plastic cover being of a second color.

8. A binder comprising front and rear hingedly connected covers, both of which are connected to an intermediary panel, said intermediary panel having a paper retaining means secured thereto, wherein at least one of said covers comprises:

a relatively stiff panel, a first plastic cover overlaying the inner surface of said panel, a second plastic cover overlaying a portion of said first plastic cover, said second plastic cover secured to said first plastic cover along three sides thereof for forming a first wall of a binder pocket, said overlaid portion of said first plastic cover forming a second wall of said binder pocket, said first wall having a plurality of apertures therein arranged in geometric pattern comprised of staggered rows of said apertures such that portions of said second wall are visible therethrough, said second plastic cover extending across said intermediary panel.

9. A binder as claimed in claim 8 wherein said binder pocket has a vertical opening.

10. A binder as claimed in claim 9 wherein said opening extends approximately from the top to the bottom of said panel.

11. A binder as claimed in claim 9 wherein said second plastic cover overlays more than one-half of said first plastic cover.

12. A binder as claimed in claim 8 wherein said first wall includes a first solid border section between said vertical opening and said geometric pattern.

13. A binder as claimed in claim 12 wherein said first wall includes a second solid border section adjacent said geometric pattern.

14. A binder as claimed in claim 8 wherein said second plastic cover extends completely across said intermediary panel.

15. A binder as claimed in claim 8 wherein said first plastic cover being of a first color and said second plastic cover being of a second color.

16. A binder comprising front and rear hingedly connected covers wherein at least one of said covers comprises:

a relatively stiff panel, a first plastic cover overlaying the inner surface of said panel, a second plastic cover overlaying a portion of said first plastic cover, said plastic cover secured to said first plastic cover along three sides thereof for forming a first wall of a binder pocket, said overlaid portion of said first plastic cover forming a second wall of said binder pocket, said unsecured side of said second plastic cover forming an opening the height of said opening extending approximately from the top to the bottom of said panel, said first wall having a plurality of vertically spaced apertures therein such that portions of said second wall are visible therethrough.

17. A binder as claimed in claim 16 wherein said apertures are arranged in geometric pattern.

18. A binder as claimed in claim 16 wherein said first wall includes a first solid border section between said opening and said geometric pattern.

19. A binder as claimed in claim 18 wherein said first wall includes a second solid border section adjacent said geometric pattern.

20. A binder as claimed in claim 16 wherein said first plastic cover being a first color and said second plastic cover being a second color.

* * * * *

UNITED STATES PATENT AND TRADEMARK OFFICE

CERTIFICATE OF CORRECTION

PATENT NO. : 4,848,798

DATED : July 18, 1989

INVENTOR(S) : Marc L. Moor

It is certified that error appears in the above-identified patent and that said Letters Patent is hereby corrected as shown below:

Column 4, line 26 (CLAIM 2)

Insert -- 1 -- after "claim"

Signed and Sealed this

Tenth Day of April, 1990

*Attest:*

HARRY F. MANBECK, JR.

*Attesting Officer*

*Commissioner of Patents and Trademarks*